US012533599B1

(12) United States Patent
Huang

(10) Patent No.: US 12,533,599 B1
(45) Date of Patent: Jan. 27, 2026

(54) BUILDING BLOCK

(71) Applicant: Shenzhen BLACK TECH Co., Ltd., Shenzhen (CN)

(72) Inventor: Lianwu Huang, Shenzhen (CN)

(73) Assignee: Shenzhen BLACK TECH Co., Ltd., Shenzhen (CN)

( * ) Notice: Subject to any disclaimer, the term of this patent is extended or adjusted under 35 U.S.C. 154(b) by 0 days.

(21) Appl. No.: 18/955,069

(22) Filed: Nov. 21, 2024

(30) Foreign Application Priority Data

Nov. 15, 2024 (CN) ..... 202422798945.4

(51) Int. Cl.
*A63H 33/04* (2006.01)

(52) U.S. Cl.
CPC ..... *A63H 33/046* (2013.01)

(58) Field of Classification Search
CPC ..... A63H 33/04; A63H 33/046; A63H 33/10
USPC ..... 446/92
See application file for complete search history.

(56) References Cited

U.S. PATENT DOCUMENTS 6,024,626 A * 2/2000 Mendelsohn ..... A63H 33/046 446/124
6,749,480 B1 * 6/2004 Hunts ..... A63H 33/046 446/85
8,850,683 B2 * 10/2014 Haughey ..... A63H 33/046 446/124
9,821,244 B1 * 11/2017 Whang ..... A63H 33/046
11,406,909 B2 * 8/2022 Zhang ..... A63H 33/26
11,547,948 B2 * 1/2023 Haughey ..... F16B 21/073
11,766,622 B1 * 9/2023 Chen ..... A63H 33/046 446/92
12,151,182 B2 * 11/2024 Chen ..... A63H 33/046
2015/0004870 A1 * 1/2015 Haughey ..... A63H 33/046 446/92
2015/0065007 A1 * 3/2015 Klepper ..... A63H 33/046 446/92
2015/0258462 A1 * 9/2015 Wei ..... A63H 33/06 446/92
2016/0199749 A1 * 7/2016 Whittaker ..... A63H 33/046 434/278
2022/0047960 A1 * 2/2022 Hoenigschmid ..... A63H 33/046

* cited by examiner

*Primary Examiner* — Kurt Fernstrom

(57) ABSTRACT

A building block includes a building block main body and a magnet. The building block main body is formed by a plurality of sidewalls connected to each other. A crossed corner is formed at a junction between adjacent sidewalls. An inner enclosure wall and a stop column are arranged at the crossed corner. A compartment is formed by surrounding the inner enclosure wall and the sidewall. The stop column is positioned in the compartment, and the inner enclosure wall and the stop column are integrally formed. The inner enclosure wall and the stop column are configured for stopping the magnet at the crossed corner.

19 Claims, 8 Drawing Sheets

BUILDING BLOCK

CROSS-REFERENCE TO RELATED APPLICATIONS

The present invention claims priority of Chinese patent application CN2024227989454, filed on Nov. 15, 2024, which is incorporated herein by reference in its entireties.

TECHNICAL FIELD

The present invention relates to the field of toys, in particular to a building block.

BACKGROUND

In recent years, 3D magnetic educational building blocks have become increasingly popular toys. They can be utilized to construct three-dimensional structures, which is conducive to the development of children's imagination. Currently, the available magnetic building blocks in the market have a single stacking angle. Typically, these magnetic building blocks can only be stacked along the same axis, resulting in a monotonous playing method and an inability to achieve more connection options. For instance, they are incapable of realizing the design and construction of staggered formations, which significantly dampens children's enthusiasm for building models.

A magnetic building block featuring diverse stacking angles, multiple connection methods, and rich gameplay has emerged in the market. However, due to the complexity of the building block's main body and internal structure, issues such as intricate processing and high production costs have arisen during the production process. Consequently, it is necessary to provide a magnetic building block that can simplify the production process, reduce production costs, mitigate the complexity in the assembly process, and enhance the user experience.

SUMMARY

The present invention provides a building block, which can simplify the production process of the building block, reduce the production cost, mitigate the complexity during the assembly process, and enhance the user experience.

A building block includes a building block main body and a magnet. The building block main body is formed by a plurality of sidewalls connected to each other, a crossed corner is formed at a junction between adjacent sidewalls, an inner enclosure wall and a stop column are arranged at the crossed corner, a compartment is formed by surrounding the inner enclosure wall and the sidewall, the stop column is positioned in the compartment, and the inner enclosure wall and the stop column are integrally formed. The inner enclosure wall and the stop column are configured for stopping the magnet at the crossed corner.

Further, the plurality of sidewalls include a circumferential surrounding wall group, an upper sidewall and a lower sidewall formed by connecting in sequence, an upper side of the circumferential surrounding wall group is connected to the upper sidewall, a lower side of the circumferential surrounding wall group is connected to the lower sidewall, a first chamber is formed by jointly surrounding the circumferential surrounding wall group, the upper sidewall and the lower sidewall, and the circumferential surrounding wall group, the inner enclosure wall and the stop column are integrally formed.

Further, the upper sidewall is connected to the circumferential surrounding wall group by ultrasonic welding.

Further, the lower sidewall is connected to the circumferential surrounding wall group by ultrasonic welding.

Further, the inner enclosure wall includes a first enclosure edge and a second enclosure edge connected to two adjacent sidewalls respectively, the first enclosure edge is connected to the second enclosure edge and an included angle is formed, the stop column is connected to the inner enclosure wall through a connecting arm, and the connecting arm is connected at the included angle.

Further, the connecting arm is positioned at a middle position of the included angle.

Further, the inner enclosure wall further includes a connecting column arranged between the first enclosure edge and the second enclosure edge, and the connecting arm is connected to the connecting column.

Further, the connecting column is provided with a mounting through hole, an upper mounting column is arranged at an inner side of a connection between the upper sidewall and the circumferential surrounding wall group, and when the upper sidewall is connected to the circumferential surrounding wall group, the upper mounting column is matched with and inserted into the mounting through hole; a lower mounting column is arranged at an inner side of a connection between the lower sidewall and the circumferential surrounding wall group, and when the lower sidewall is connected to the circumferential surrounding wall group, the lower mounting column is matched with and inserted into the mounting through hole.

Further, the building block main body is in the shape of a square, the circumferential surrounding wall group includes a front sidewall, a rear sidewall, a left sidewall and a right sidewall, a right side of the front sidewall is connected to the right sidewall, an upper side of the front sidewall and an upper side of the right sidewall are respectively connected to the upper sidewall, and a lower side of the front sidewall and a lower side of the right sidewall are respectively connected to the lower sidewall; a left side of the front sidewall is connected to the left sidewall, the upper side of the front sidewall and an upper side of the left sidewall are respectively connected to the upper sidewall, and the lower side of the front sidewall and a lower side of the left sidewall are respectively connected to the lower sidewall; a right side of the rear sidewall is connected to the right sidewall, an upper side of the rear sidewall and the upper side of the right sidewall are respectively connected to the upper sidewall, and a lower side of the rear sidewall and the lower side of the right sidewall are respectively connected to the lower sidewall; a left side of the rear sidewall is connected to the left sidewall, the upper side of the rear sidewall and the upper side of the left sidewall are respectively connected to the upper sidewall, and the lower side of the rear sidewall and the lower side of the left sidewall are respectively connected to the lower sidewall.

Further, the inner enclosure wall further includes a first inner enclosure wall, a second inner enclosure wall, a third inner enclosure wall and a fourth inner enclosure wall; the compartment includes a first compartment, a second compartment, a third compartment and a fourth compartment; the first inner enclosure wall is connected to inner surfaces of the front sidewall, the left sidewall, the upper sidewall and the lower sidewall, and they jointly surround to form the first compartment; the second inner enclosure wall is connected to inner surfaces of the front sidewall, the right sidewall, the upper sidewall and the lower sidewall, and they jointly surround to form the second compartment, the third inner enclosure wall is connected to inner surfaces of the rear sidewall, the left sidewall, the upper sidewall and the lower sidewall, and they jointly surround to form the third compartment; the fourth inner enclosure wall is connected to inner surfaces of the rear sidewall, the right sidewall, the upper sidewall and the lower sidewall, and they jointly surround to form the fourth compartment.

Further, the stop column includes a first stop column, a second stop column, a third stop column, and a fourth stop column; the first stop column is positioned in the first compartment, the second stop column is positioned in the second compartment, the third stop column is positioned in the third compartment, and the fourth stop column is positioned in the fourth compartment.

Further, the first inner enclosure wall includes a first inner enclosure edge connected to the left sidewall and a second inner enclosure edge connected to the front sidewall, the first inner enclosure edge is connected to the second inner enclosure edge and a first included angle is formed, and the first stop column is connected at the first included angle through a first connecting arm; the second inner enclosure wall includes a third inner enclosure edge connected to the right sidewall and a fourth inner enclosure edge connected to the front sidewall, the third inner enclosure edge is connected to the fourth inner enclosure edge and a second included angle is formed, and the second stop column is connected at the second included angle through a second connecting arm; the third inner enclosure wall includes a fifth inner enclosure edge connected to the left sidewall and a sixth inner enclosure edge connected to the rear sidewall, the fifth inner enclosure edge is connected to the sixth inner enclosure edge and a third included angle is formed, and the third stop column is connected at the third included angle through a third connecting arm; the fourth inner enclosure wall includes a seventh inner enclosure edge connected to the right sidewall and a eighth inner enclosure edge connected to the rear sidewall, the seventh inner enclosure edge is connected to the eighth inner enclosure edge and a fourth included angle is formed, and the fourth stop column is connected at the fourth included angle through a fourth connecting arm.

Further, the first inner enclosure wall further includes a first connecting column arranged between the first inner enclosure edge and the second inner enclosure edge, and the first connecting arm is connected to the first connecting column; the second inner enclosure wall further includes a second connecting column arranged between the third inner enclosure edge and the fourth inner enclosure edge, and the second connecting arm is connected to the second connecting column; the third inner enclosure wall further includes a third connecting column arranged between the fifth inner enclosure edge and the sixth inner enclosure edge, and the third connecting arm is connected to the third connecting column; the fourth inner enclosure wall further includes a fourth connecting column arranged between the seventh inner enclosure edge and the eighth inner enclosure edge, and the fourth connecting arm is connected to the fourth connecting column.

Further, the first connecting column is provided with a first mounting through hole, the second connecting column is provided with a second mounting through hole, the third connecting column is provided with a third mounting through hole, and the fourth connecting column is provided with a fourth mounting through hole; a first upper mounting column, a second upper mounting column, a third upper mounting column and a fourth upper mounting column are arranged at the inner side of the connection between the upper sidewall and the circumferential surrounding wall group, and a first lower mounting column, a second lower mounting column, a third lower mounting column and a fourth lower mounting column are arranged at the inner side of the connection between the lower sidewall and the circumferential surrounding wall group; when the upper sidewall is connected to the circumferential surrounding wall group, the first upper mounting column is matched with and inserted into the first mounting through hole, the second upper mounting column is matched with and inserted into the second mounting through hole, the third upper mounting column is matched with and inserted into the third mounting through hole, and the fourth upper mounting column is matched with and inserted into the fourth mounting through hole; when the lower sidewall is connected to the circumferential surrounding wall group, the first lower mounting column is matched with and inserted into the first mounting through hole, the second lower mounting column is matched with and inserted into the second mounting through hole, the third lower mounting column is matched with and inserted into the third mounting through hole, and the fourth lower mounting column is matched with and inserted into the fourth mounting through hole.

Further, the crossed corner includes a first crossed corner unit arranged at a junction between the front sidewall, the left sidewall and the upper sidewall, a second crossed corner unit arranged at a junction between the front sidewall, the left sidewall and the lower sidewall, a third crossed corner unit arranged at a junction between the front sidewall, the right sidewall and the upper sidewall, a fourth crossed corner unit arranged at a junction between the front sidewall, the right sidewall and the lower sidewall, a fifth crossed corner unit arranged at a junction between the rear sidewall, the left sidewall and the upper sidewall, a sixth crossed corner unit arranged at a junction between the rear sidewall, the left sidewall and the lower sidewall, a seventh crossed corner unit arranged at a junction between the rear sidewall, the right sidewall and the upper sidewall, and a eighth crossed corner unit arranged at a junction between the rear sidewall, the right sidewall and the lower sidewall.

Further, the first compartment includes a first upper compartment unit arranged at the first crossed corner unit and a first lower compartment unit arranged at the second crossed corner unit; the second compartment includes a second upper compartment unit arranged at the third crossed corner unit and a second lower compartment unit arranged at the fourth crossed corner unit; the third compartment includes a third upper compartment unit arranged at the fifth crossed corner unit and a third lower compartment unit arranged at the sixth crossed corner unit; and the fourth compartment includes a fourth upper compartment unit arranged at the seventh crossed corner unit and a fourth lower compartment unit arranged at the eighth crossed corner unit.

Further, the magnet includes a first magnet unit arranged in the first upper compartment unit, a second magnet unit arranged in the first lower compartment unit, a third magnet unit arranged in the second upper compartment unit, a fourth magnet unit arranged in the second lower compartment unit, a fifth magnet unit arranged in the third upper compartment unit, a sixth magnet unit arranged in the third lower compartment unit, a seventh magnet unit arranged in the fourth upper compartment unit, and a eighth magnet unit arranged in the fourth lower compartment unit.

Further, an upper side of the first stop column, the first inner enclosure wall and the upper sidewall keep the first magnet unit blocked inside the first upper compartment unit, an lower side of the first stop column, the first inner enclosure wall and the lower sidewall keep the second magnet unit blocked inside the first lower compartment unit, an upper side of the second stop column, the second inner enclosure wall and the upper sidewall keep the third magnet unit blocked inside the second upper compartment unit, an lower side of the second stop column, the second inner enclosure wall and the lower sidewall keep the fourth magnet unit blocked inside the second lower compartment unit, an upper side of the third stop column, the third inner enclosure wall and the upper sidewall keep the fifth magnet unit blocked inside the third upper compartment unit, an lower side of the third stop column, the third inner enclosure wall and the lower sidewall keep the sixth magnet unit blocked inside the third lower compartment unit, an upper side of the fourth stop column, the fourth inner enclosure wall and the upper sidewall keep the seventh magnet unit blocked inside the fourth upper compartment unit, and an lower side of the fourth stop column, the fourth inner enclosure wall and the lower sidewall keep the eighth magnet unit blocked inside the fourth lower compartment unit.

Further, the magnet is able to rotate in the compartment, and the magnet is provided with an N pole and an S pole.

Further, the building block main body is made of a light-transmitting material.

The present invention has the following beneficial effects. Through the above structure, since the building block main body is formed by the plurality of sidewalls connected to each other, the crossed corner is formed at the junction between adjacent sidewalls, and the compartment is arranged at the crossed corner. The magnet is positioned in the compartment, enabling the magnetic building blocks to attract each other through the magnets in the compartments at the crossed corners. Thus, the magnetic building blocks can be connected to each other at the crossed corners, realizing the staggered connection between the magnetic building blocks and enabling the design and construction of staggered shapes. Compared with the magnetic building blocks that can only be stacked on the same axis in the prior art, the ways of building and playing methods of the magnetic building blocks are greatly enriched, which can help children build more shapes. Moreover, various pattern combinations can be built by combining the surface patterns of the magnetic building blocks, greatly increasing children's interest in building shapes and contributing to the development of children's imagination. Moreover, since the inner enclosure wall and the stop column are integrally formed, during the production and manufacturing process, the production process of the inner enclosure wall and the stop column is simplified, the production cost is reduced, and the assembly process of the building block main body is also decreased, thereby significantly improving the production efficiency.

BRIEF DESCRIPTION OF THE DRAWINGS

Implementations of the present invention will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present invention.

DETAILED DESCRIPTION OF THE EMBODIMENTS

Figure 1:
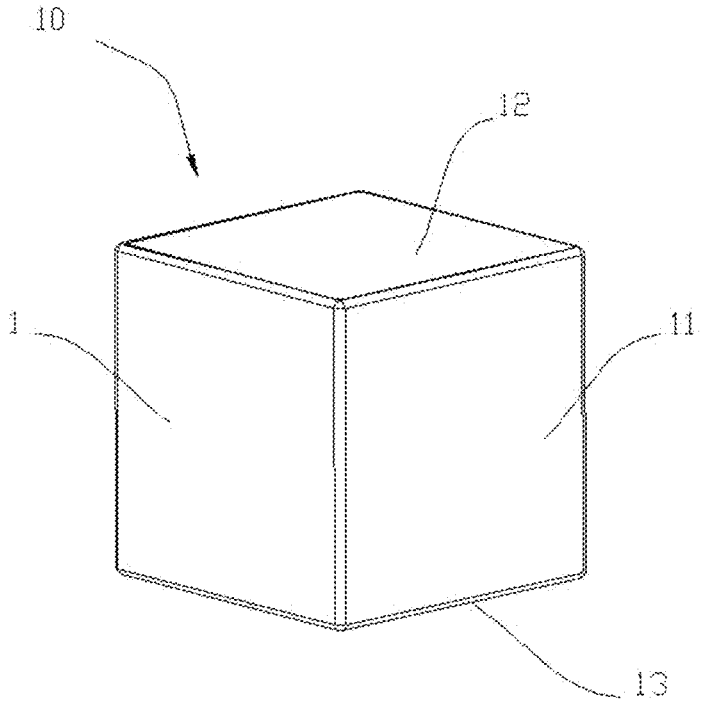
FIG. 1 is a schematic diagram of an overall structure of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present invention.

The term "comprising" when utilized, means "including, but not necessarily limited to"; it specifically indicates open-ended inclusion or membership in the so-described combination, group, series, and the like. The invention is illustrated by way of example and not by way of limitation in the figures of the accompanying drawings in which like references indicate similar elements. It should be noted that references to "an" or "one" embodiment in this invention are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
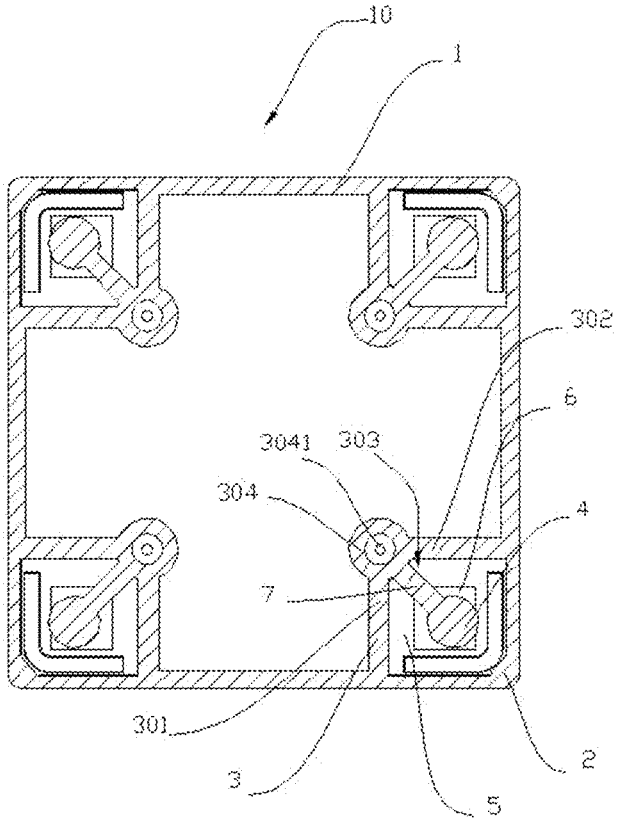
FIG. 2 is a cross-sectional view cut along a stop column of the present invention.
Figure 3:
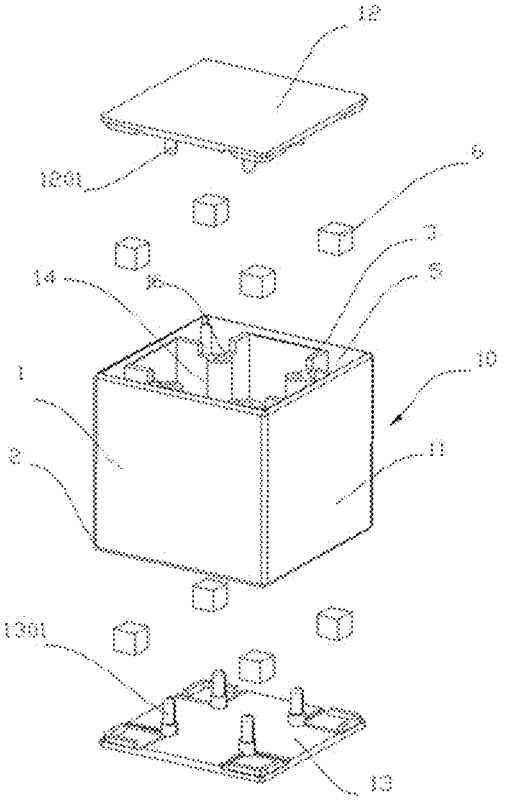
FIG. 3 is an exploded view of the present invention.
Figure 4:
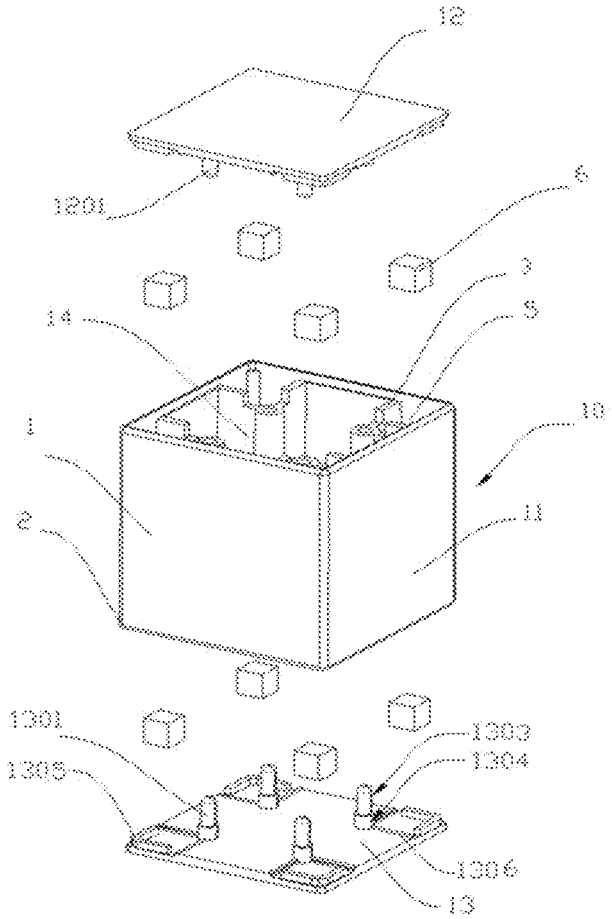
FIG. 4 is another exploded view of the present invention.
Figure 5:
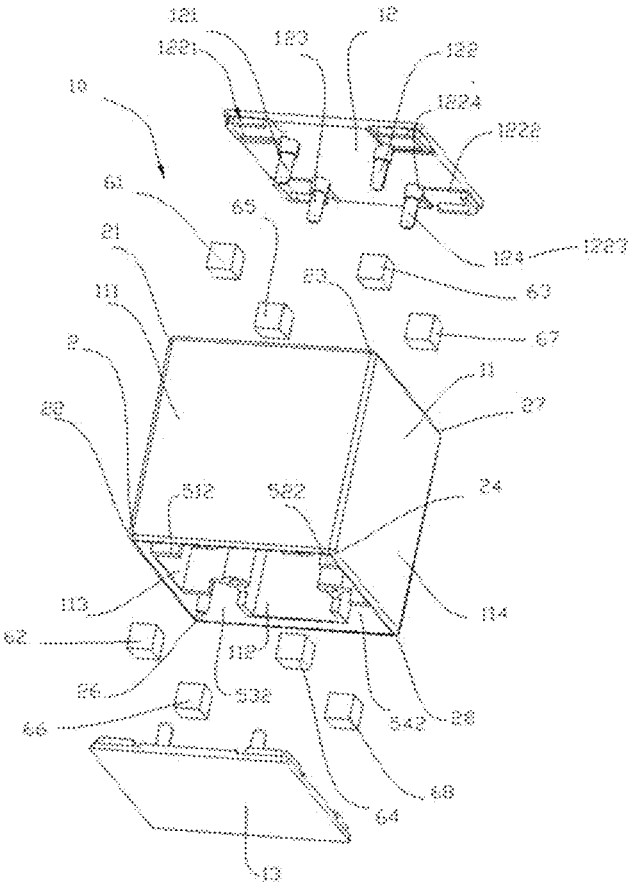
FIG. 5 is another perspective view of an exploded view of the present invention.
Figure 6:
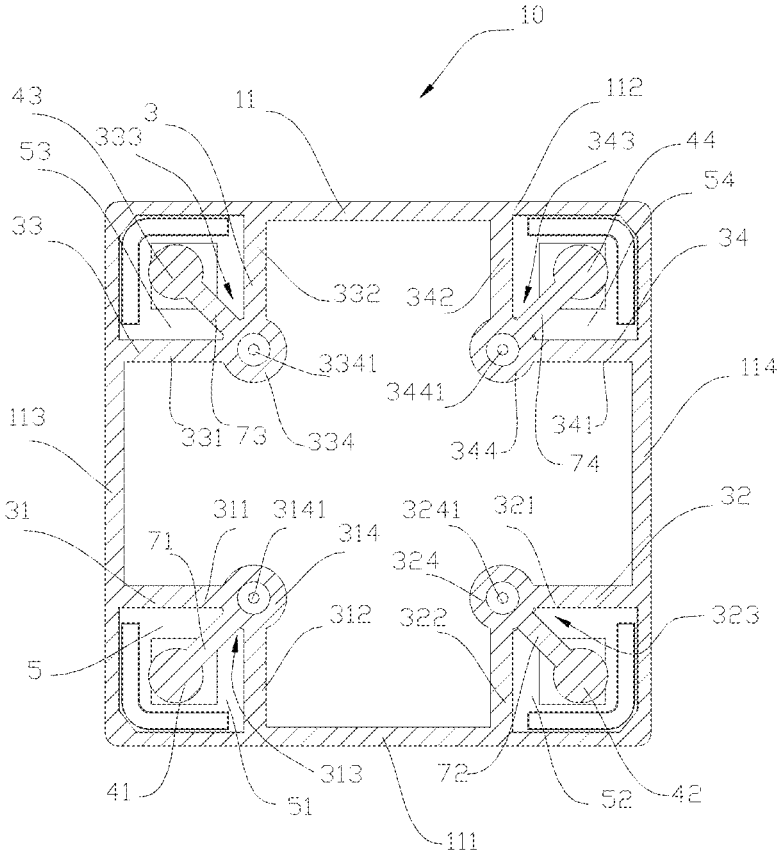
FIG. 6 is another cross-sectional view cut along the stop column of the present invention.
Figure 7:
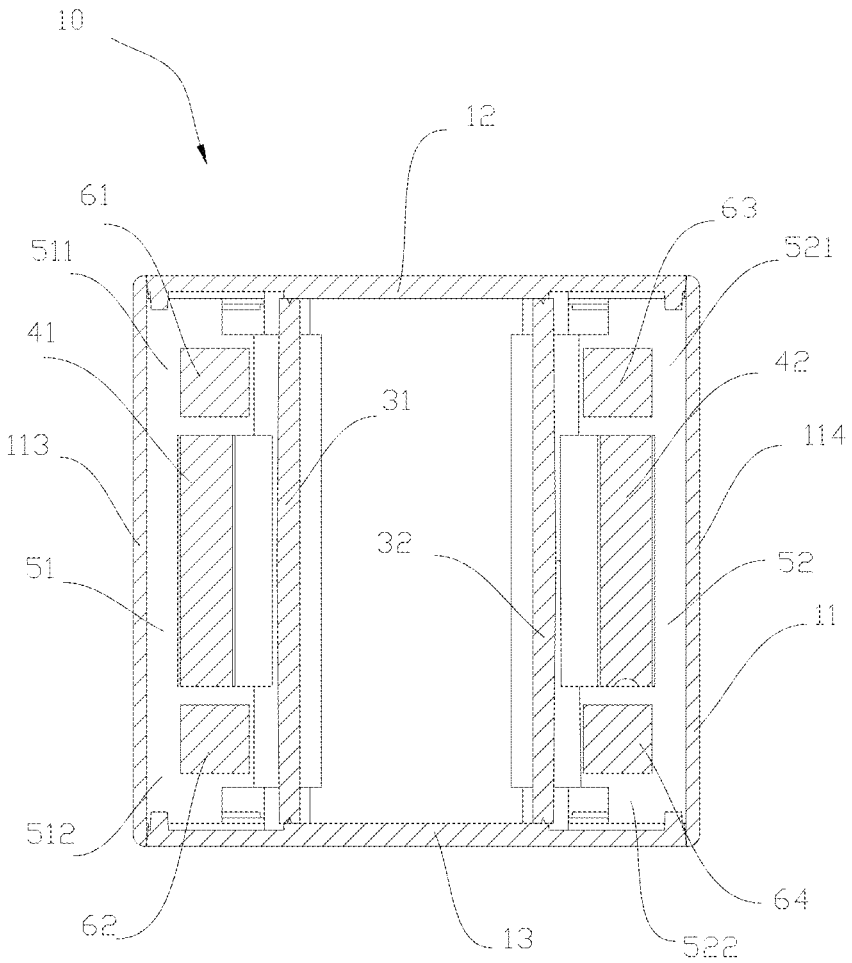
FIG. 7 is an cross-sectional view cut along a first stop column and a second stop column of the present invention.
Figure 8:
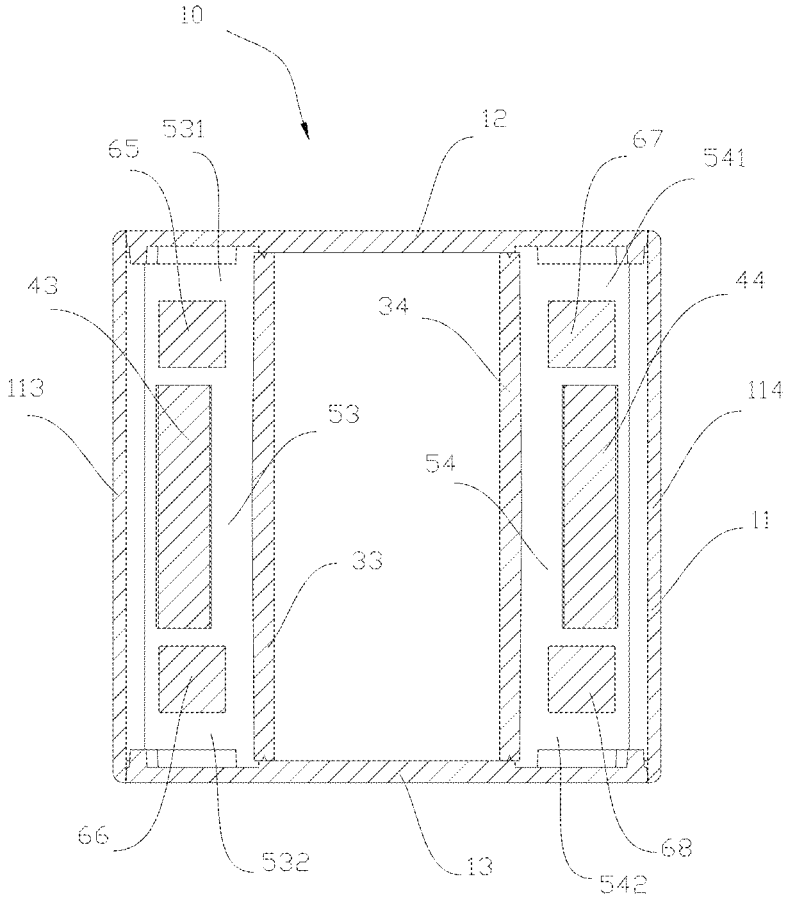
FIG. 8 is an cross-sectional view cut along a third stop column and a fourth stop column of the present invention.

Referring to FIG. 1 to FIG. 8, a building block includes a building block main body 10, the building block main body 10 is formed by a plurality of sidewalls 1 connected to each other, a crossed corner 2 is formed at a junction between adjacent sidewalls 1, an inner enclosure wall 3 and a stop column 4 are arranged at the crossed corner 2, a compartment 5 is formed by surrounding the inner enclosure wall 3 and the sidewall 1, the stop column 4 is positioned in the compartment 5, and the inner enclosure wall 3 and the stop column 4 are integrally formed. The building block includes a magnet 6, the inner enclosure wall 3 and the stop column 4 arc configured for stopping the magnet 6 at the crossed corner 2.

Through the above structure, since the building block main body 10 is formed by the plurality of sidewalls 1 connected to each other, the crossed corner 2 is formed at the junction between adjacent sidewalls 1, and the compartment 5 is arranged at the crossed corner 2. The magnet 6 is positioned in the compartment 5, enabling the magnetic building blocks to attract each other through the magnets 6 in the compartments 5 at the crossed corners 2. Thus, the magnetic building blocks can be connected to each other at the crossed corners 2, realizing the staggered connection between the magnetic building blocks and enabling the design and construction of staggered shapes. Compared with the magnetic building blocks that can only be stacked on the same axis in the prior art, the ways of building and playing methods of the magnetic building blocks are greatly enriched, which can help children build more shapes. Moreover, various pattern combinations can be built by combining the surface patterns of the magnetic building blocks, greatly increasing children's interest in building shapes and contributing to the development of children's imagination. Moreover, since the inner enclosure wall 3 and the stop column 4 are integrally formed, during the production and manufacturing process, the production process of the inner enclosure wall 3 and the stop column 4 is simplified, the production cost is reduced, and the assembly process of the building block main body 10 is also decreased, thereby significantly improving the production efficiency.

In this embodiment, the plurality of sidewalls 1 include a circumferential surrounding wall group 11, an upper sidewall 12 and a lower sidewall 13 formed by connecting in sequence, an upper side of the circumferential surrounding wall group 11 is connected to the upper sidewall 12, a lower side of the circumferential surrounding wall group 11 is connected to the lower sidewall 13, a first chamber 14 is formed by jointly surrounding the circumferential surrounding wall group 11, the upper sidewall 12 and the lower sidewall 13, and the circumferential surrounding wall group 11, the inner enclosure wall 3 and the stop column 4 are integrally formed.

Through the above structure, the building block main body 10 is surrounded by the circumferential surrounding wall group 11, the upper sidewall 12 and the lower sidewall 13 to form a complete building block, and each building block can be stacked through the contact between each sidewall 1. Further, since the circumferential surrounding wall group 11, the inner enclosure wall 3 and the stop column 4 are integrally formed, the circumferential surrounding wall, the inner enclosure wall 3 and the stop column 4 can be formed and manufactured at one time during the production process, reducing the use of molds and the building block assembly process and greatly improving the production efficiency.

In this embodiment, the upper sidewall 12 is connected to the circumferential surrounding wall group 11 by ultrasonic welding. Meanwhile, the lower sidewall 13 is connected to the circumferential surrounding wall group 11 by ultrasonic welding.

Through the above structure, after the circumferential surrounding wall group 11, the inner enclosure wall 3 and the stop column 4 are integrally formed and processed, the upper sidewall 12 and the lower sidewall 13 are respectively welded to the upper side and the lower side of the circumferential surrounding wall group 11 by means of ultrasonic welding, thereby realizing the complete assembly of the building block main body 10. The ultrasonic welding technology is energy-saving and environmentally friendly, not only highly efficient but also of low cost. By applying the ultrasonic welding technology to weld the upper sidewall 12 and the lower sidewall 13 on the upper and lower sides of the circumferential surrounding wall, it can both ensure the structural stability of the building block main body 10 and maintain its aesthetic appearance. Moreover, it has good waterproof, moisture-proof and airtight properties, preventing the magnet 6 from getting damp and rusty inside the building block and thus prolonging the service life of the building block product.

In this embodiment, the inner enclosure wall 3 includes a first enclosure edge 301 and a second enclosure edge 302 connected to two adjacent sidewalls 1 respectively, the first enclosure edge 301 is connected to the second enclosure edge 302 and an included angle 303 is formed, the stop column 4 is connected to the inner enclosure wall 3 through a connecting arm 7, and the connecting arm 7 is connected at the included angle 303. Specifically, the connecting arm 7 is positioned at a middle position of the included angle 303.

Through the above structure, since the stop column 4 is connected to the inner enclosure wall 3 through the connecting arm 7 and is positioned at the middle position of the included angle 303, the stop column 4 can be placed in the middle part of the compartment 5, thereby better realizing the blocking or supporting of the magnet 6. This not only makes the building block structure stable but also brings a more aesthetic appearance. Compared with the connecting column 304 or other connecting structures, the connecting arm 7 is also more solid and stable.

In this embodiment, the inner enclosure wall 3 further comprises a connecting column 304 arranged between the first enclosure edge 301 and the second enclosure edge 302, and the connecting arm 7 is connected to the connecting column 304. A height of the connecting column 304 is less than that of the first enclosure edge 301 and the second enclosure edge 302, such that an upper end of the connecting column 304 and the first enclosure edge 301 and the second enclosure edge 302 cooperatively form an upper notch, and a lower end of the connecting column 304 and the first enclosure edge 301 and the second enclosure edge 302 cooperatively form a lower notch.

Through the above structure, by arranging the connecting column 304, the connecting arm 7 can be connected to the inner enclosure wall 3 in a better way. It also facilitates the molds for production and reduces the difficulty of manufacturing.

Furthermore, the connecting column 304 is provided with a mounting through hole 3041, an upper mounting column 1201 is arranged at an inner side of a connection between the upper sidewall 12 and the circumferential surrounding wall group 11, and when the upper sidewall 12 is connected to the circumferential surrounding wall group 11, the upper mounting column 1201 is matched with and inserted into the mounting through hole 3041; a lower mounting column 1301 is arranged at an inner side of a connection between the lower sidewall 13 and the circumferential surrounding wall group 11, and when the lower sidewall 13 is connected to the circumferential surrounding wall group 11, the lower mounting column 1301 is matched with and inserted into the mounting through hole 3041. Specifically, the upper mounting column 1201 is integrally formed with the upper sidewall 12 and faces towards the connecting column 304, and the upper mounting column 1201 includes a first part connected to the upper sidewall 12 and a second part connected to the first part, with a diameter of the first part being greater than that of the second part, and a height of first part being less than that of the second part; the first part is positioned in the upper notch, and the second part is engaged in the mounting through hole 3041. The lower mounting column 1301 is integrally formed with the lower sidewall 13 and faces towards the connecting column 304, and the lower mounting column 3041 includes a third part connected to the lower sidewall and a fourth part connected to the third part, with a diameter of the third part being greater than that of the fourth part, and a height of third part being less than that of the fourth part; the third part is positioned in the lower notch, and the fourth part is engaged in the mounting through hole 3041.

In some other embodiments, the mounting through hole 3041 of the connecting column 304 is not connected in the middle. Instead, a mounting groove is arranged on each of opposite sides of the connecting column 304. In this embodiment, since the connecting column 304 is provided with the mounting through hole 3041, when the upper sidewall 12 and the lower sidewall 13 are connected to the circumferential surrounding wall group 11, it can not only play a positioning role but also ensure better connection stability between the upper sidewall 12 and the lower sidewall 13 and the circumferential surrounding wall group 11.

Referring to FIG. 4 to FIG. 8, in this embodiment, the building block main body 10 is in the shape of a square, the circumferential surrounding wall group 11 includes a front sidewall 111, a rear sidewall 112, a left sidewall 113 and a right sidewall 114, a right side of the front sidewall 111 is connected to the right sidewall 114, an upper side of the front sidewall 111 and an upper side of the right sidewall 114 are respectively connected to the upper sidewall 12, and a lower side of the front sidewall 111 and a lower side of the right sidewall 114 are respectively connected to the lower sidewall 13; a left side of the front sidewall 111 is connected to the left sidewall 113, the upper side of the front sidewall 111 and an upper side of the left sidewall 113 are respectively connected to the upper sidewall 12, and the lower side of the front sidewall 111 and a lower side of the left sidewall 113 are respectively connected to the lower sidewall 13; a right side of the rear sidewall 112 is connected to the right sidewall 114, an upper side of the rear sidewall 112 and the upper side of the right sidewall 114 are respectively connected to the upper sidewall 12, and a lower side of the rear sidewall 112 and the lower side of the right sidewall 114 are respectively connected to the lower sidewall 13; a left side of the rear sidewall 112 is connected to the left sidewall 113, the upper side of the rear sidewall 112 and the upper side of the left sidewall 113 are respectively connected to the upper sidewall 12, and the lower side of the rear sidewall 112 and the lower side of the left sidewall 113 are respectively connected to the lower sidewall 13.

Furthermore, the inner enclosure wall 3 further includes a first inner enclosure wall 31, a second inner enclosure wall 32, a third inner enclosure wall 33 and a fourth inner enclosure wall 34; the compartment 5 includes a first compartment 51, a second compartment 52, a third compartment 53 and a fourth compartment 54; the first inner enclosure wall 31 is connected to inner surfaces of the front sidewall 111, the left sidewall 113, the upper sidewall 12 and the lower sidewall 13, and they jointly surround to form the first compartment 51; the second inner enclosure wall 32 is connected to inner surfaces of the front sidewall 111, the right sidewall 114, the upper sidewall 12 and the lower sidewall 13, and they jointly surround to form the second compartment 52, the third inner enclosure wall 33 is connected to inner surfaces of the rear sidewall 112, the left sidewall 113, the upper sidewall 12 and the lower sidewall 13, and they jointly surround to form the third compartment 53; the fourth inner enclosure wall 34 is connected to inner surfaces of the rear sidewall 112, the right sidewall 114, the upper sidewall 12 and the lower sidewall 13, and they jointly surround to form the fourth compartment 54.

Furthermore, the stop column 4 includes a first stop column 41, a second stop column 42, a third stop column 43, and a fourth stop column 44; the first stop column 41 is positioned in the first compartment 51, the second stop column 42 is positioned in the second compartment 52, the third stop column 43 is positioned in the third compartment 53, and the fourth stop column 44 is positioned in the fourth compartment 54.

Furthermore, the crossed corner 2 includes a first crossed corner unit 21 arranged at a junction between the front sidewall 111, the left sidewall 113 and the upper sidewall 12, a second crossed corner unit 22 arranged at a junction between the front sidewall 111, the left sidewall 113 and the lower sidewall 13, a third crossed corner unit 23 arranged at a junction between the front sidewall 111, the right sidewall 114 and the upper sidewall 12, a fourth crossed corner unit 24 arranged at a junction between the front sidewall 111, the right sidewall 114 and the lower sidewall 13, a fifth crossed corner unit 25 arranged at a junction between the rear sidewall 112, the left sidewall 113 and the upper sidewall 12, a sixth crossed corner unit 26 arranged at a junction between the rear sidewall 112, the left sidewall 113 and the lower sidewall 13, a seventh crossed corner unit 27 arranged at a junction between the rear sidewall 112, the right sidewall 114 and the upper sidewall 12, and a eighth crossed corner unit 28 arranged at a junction between the rear sidewall 112, the right sidewall 114 and the lower sidewall 13.

Furthermore, the first compartment 51 includes a first upper compartment unit 511 arranged at the first crossed corner unit 21 and a first lower compartment unit 512 arranged at the second crossed corner unit 22; the second compartment 52 includes a second upper compartment unit 521 arranged at the third crossed corner unit 23 and a second lower compartment unit 522 arranged at the fourth crossed corner unit 24; the third compartment 53 includes a third upper compartment unit 531 arranged at the fifth crossed corner unit 25 and a third lower compartment unit 532 arranged at the sixth crossed corner unit 26; and the fourth compartment 54 includes a fourth upper compartment unit 541 arranged at the seventh crossed corner unit 27 and a fourth lower compartment unit 542 arranged at the eighth crossed corner unit 28.

Furthermore, the magnet 6 includes a first magnet unit 61 arranged in the first upper compartment unit 511, a second magnet unit 62 arranged in the first lower compartment unit 512, a third magnet unit 63 arranged in the second upper compartment unit 521, a fourth magnet unit 64 arranged in the second lower compartment unit 522, a fifth magnet unit 65 arranged in the third upper compartment unit 531, a sixth magnet unit 66 arranged in the third lower compartment unit 532, a seventh magnet unit 67 arranged in the fourth upper compartment unit 541, and a eighth magnet unit 68 arranged in the fourth lower compartment unit 542.

Furthermore, an upper side of the first stop column 41, the first inner enclosure wall 31 and the upper sidewall 12 keep the first magnet unit 61 blocked inside the first upper compartment unit 511, an lower side of the first stop column 41, the first inner enclosure wall 31 and the lower sidewall 13 keep the second magnet unit 62 blocked inside the first lower compartment unit 512, an upper side of the second stop column 42, the second inner enclosure wall 32 and the upper sidewall 12 keep the third magnet unit 63 blocked inside the second upper compartment unit 521, an lower side of the second stop column 42, the second inner enclosure wall 32 and the lower sidewall 13 keep the fourth magnet unit 64 blocked inside the second lower compartment unit 522, an upper side of the third stop column 43, the third inner enclosure wall 33 and the upper sidewall 12 keep the fifth magnet unit 65 blocked inside the third upper compartment unit 531, an lower side of the third stop column 43, the third inner enclosure wall 33 and the lower sidewall 13 keep the sixth magnet unit 66 blocked inside the third lower compartment unit 532, an upper side of the fourth stop column 44, the fourth inner enclosure wall 34 and the upper sidewall 12 keep the seventh magnet unit 67 blocked inside the fourth upper compartment unit 541, and an lower side of the fourth stop column 44, the fourth inner enclosure wall 34 and the lower sidewall 13 keep the eighth magnet unit 68 blocked inside the fourth lower compartment unit 542.

Through the above structure, the design is reasonable, the structure is simple, and the connection is stable. By arranging magnets 6 in the first upper compartment unit 511, the first lower compartment unit 512, the second upper compartment unit 521, the second lower compartment unit 522, the third upper compartment unit 531, the third lower compartment unit 532, the fourth upper compartment unit 541, and the fourth lower compartment unit 542 of the square building blocks, the magnetic building blocks can be mutually misaligned and connected or stacked at the corners of each sidewall 1, so as to realize the design and construction of misaligned shapes.

Among them, a transverse diagonal width of the magnet 6 is less than a transverse width, transverse length, and longitudinal height of each compartment unit. A longitudinal diagonal width of the magnet 6 is also less than the transverse width, transverse length, and longitudinal height of each compartment unit. Moreover, a longitudinal height of the magnet 6 is less than the transverse width, transverse length, and longitudinal height of each compartment unit. By arranging the first stop column 41, the second stop column 42, the third stop column 43 and the fourth stop column 44, it is ensured that the magnet 6 is limited between the various compartments and can rotate freely within the compartment 5.

In this embodiment, the first inner enclosure wall 31 includes a first inner enclosure edge 311 connected to the left sidewall 113 and a second inner enclosure edge 312 connected to the front sidewall 111, the first inner enclosure edge 311 is connected to the second inner enclosure edge 312 and a first included angle 313 is formed, and the first stop column 41 is connected at the first included angle 313 through a first connecting arm 71; the second inner enclosure wall 32 includes a third inner enclosure edge 321 connected to the right sidewall 114 and a fourth inner enclosure edge 322 connected to the front sidewall 111, the third inner enclosure edge 321 is connected to the fourth inner enclosure edge 322 and a second included angle 323 is formed, and the second stop column 42 is connected at the second included angle 323 through a second connecting arm 72; the third inner enclosure wall 33 includes a fifth inner enclosure edge 331 connected to the left sidewall 113 and a sixth inner enclosure edge 332 connected to the rear sidewall 112, the fifth inner enclosure edge 331 is connected to the sixth inner enclosure edge 332 and a third included angle 333 is formed, and the third stop column 43 is connected at the third included angle 333 through a third connecting arm 73; the fourth inner enclosure wall 34 includes a seventh inner enclosure edge 341 connected to the right sidewall 114 and a eighth inner enclosure edge 342 connected to the rear sidewall 112, the seventh inner enclosure edge 341 is connected to the eighth inner enclosure edge 342 and a fourth included angle 343 is formed, and the fourth stop column 42 is connected at the fourth included angle 343 through a fourth connecting arm 74.

Furthermore, the first inner enclosure wall 31 further includes a first connecting column 314 arranged between the first inner enclosure edge 311 and the second inner enclosure edge 312, and the first connecting arm 71 is connected to the first connecting column 314; the second inner enclosure wall 32 further includes a second connecting column 324 arranged between the third inner enclosure edge 321 and the fourth inner enclosure edge 322, and the second connecting arm 72 is connected to the second connecting column 324; the third inner enclosure wall 33 further includes a third connecting column 334 arranged between the fifth inner enclosure edge 331 and the sixth inner enclosure edge 332, and the third connecting arm 73 is connected to the third connecting column 334; the fourth inner enclosure wall 34 further includes a fourth connecting column 344 arranged between the seventh inner enclosure edge 341 and the eighth inner enclosure edge 342, and the fourth connecting arm 74 is connected to the fourth connecting column 344.

Furthermore, the first connecting column 314 is provided with a first mounting through hole 3141, the second connecting column 324 is provided with a second mounting through hole 3241, the third connecting column 334 is provided with a third mounting through hole 3341, and the fourth connecting column 344 is provided with a fourth mounting through hole 3441; a first upper mounting column 121, a second upper mounting column 122, a third upper mounting column 123 and a fourth upper mounting column 124 are arranged at the inner side of the connection between the upper sidewall 12 and the circumferential surrounding wall group 11, and a first lower mounting column 131, a second lower mounting column 132, a third lower mounting column 133 and a fourth lower mounting column 134 are arranged at the inner side of the connection between the lower sidewall 13 and the circumferential surrounding wall group 11; when the upper sidewall 12 is connected to the circumferential surrounding wall group 11, the first upper mounting column 121 is matched with and inserted into the first mounting through hole 3141, the second upper mounting column 122 is matched with and inserted into the second mounting through hole 3241, the third upper mounting column 123 is matched with and inserted into the third mounting through hole 3341, and the fourth upper mounting column 124 is matched with and inserted into the fourth mounting through hole 3441; when the lower sidewall 13 is connected to the circumferential surrounding wall group 11, the first lower mounting column 131 is matched with and inserted into the first mounting through hole 3141, the second lower mounting column 132 is matched with and inserted into the second mounting through hole 3241, the third lower mounting column 133 is matched with and inserted into the third mounting through hole 3341, and the fourth lower mounting column 134 is matched with and inserted into the fourth mounting through hole 3441.

Through the above structure, the design is reasonable and the structure is aesthetically pleasing. When the upper sidewall 12 and the lower sidewall 13 are connected to the circumferential surrounding wall group 11, it can not only play a positioning role but also ensure better connection stability between the upper sidewall 12 and the lower sidewall 13 and the circumferential surrounding wall group 11.

In this embodiment, the magnet 6 is able to rotate in the compartment 5, and the magnet 6 is provided with an N pole and an S pole. Since the magnet 6 can rotate in the compartment 5 and is provided with the N pole and the S pole, when the magnetic building blocks are stacked on each other at the crossed corner 2, the magnet 6 of the magnetic building block can rotate to easily guide the N pole of the magnetic building block to be tightly attracted to the S pole of another identical magnetic building block, or guide the S pole of the magnetic building block to be tightly attracted to the N pole of another identical magnetic building block, thereby achieving a stable connection between the magnetic building blocks, realizing the misaligned connection between the magnetic building blocks, and finally realizing the design and construction of misaligned shapes.

In this embodiment, the building block main body 10 is made of a light-transmitting material. Through the above structure, the building block main body 10 made of the light-transmitting material makes its appearance more aesthetically pleasing.

The above description only describes embodiments of the present invention, and is not intended to limit the present invention; various modifications and changes can be made to the present invention. Any modifications, equivalent substitutions, and improvements made within the spirit and scope of the present invention are intended to be included within the scope of the present invention.

What is claimed is:

1. A building block, comprising:

a building block main body, wherein the building block main body is formed by a plurality of sidewalls connected to each other, a crossed corner is formed at a junction between adjacent sidewalls, an inner enclosure wall and a stop column are arranged at the crossed corner, a compartment is formed by surrounding the inner enclosure wall and the adjacent sidewalls, the stop column is positioned in the compartment, and the inner enclosure wall and the stop column are integrally formed; and a rotatable magnet, wherein the inner enclosure wall and the stop column are configured for stopping the magnet at the crossed corner;

wherein the building block main body is made of a light-transmitting material, and there is no connection between each two of the stop columns, thereby forming a central space of the building block main body is hollow;

wherein the plurality of sidewalls comprise a circumferential surrounding wall group, an upper sidewall and a lower sidewall formed by connecting in sequence; and the inner enclosure wall comprises a first enclosure edge and a second enclosure edge connected to two adjacent sidewalls respectively, the first enclosure edge is connected to the second enclosure edge and an included angle is formed, the stop column is connected to the inner enclosure wall through a connecting arm, and the connecting arm is connected at the included angle;

the inner enclosure wall further comprises a connecting column arranged between the first enclosure edge and the second enclosure edge, and the connecting arm is connected to the connecting column; a height of the connecting column is less than that of the first enclosure edge and the second enclosure edge, such that an upper end of the connecting column and the first enclosure edge and the second enclosure edge cooperatively form an upper notch, and a lower end of the connecting column and the first enclosure edge and the second enclosure edge cooperatively form a lower notch;

wherein the connecting column is provided with a mounting through hole, an upper mounting column is arranged at an inner side of a connection between the upper sidewall and the circumferential surrounding wall group, and when the upper sidewall is connected to the circumferential surrounding wall group, the upper mounting column is matched with and inserted into the mounting through hole; a lower mounting column is arranged at an inner side of a connection between the lower sidewall and the circumferential surrounding wall group, and when the lower sidewall is connected to the circumferential surrounding wall group, the lower mounting column is matched with and inserted into the mounting through hole;

wherein the upper mounting column is integrally formed with the upper sidewall and faces towards the connecting column, the upper mounting column includes a first part connected to the upper sidewall and a second part connected to the first part, with a diameter of the first part being greater than that of the second part, and a height of first part being less than that of the second part; the first part is positioned in the upper notch, and the second part is engaged in the mounting through hole;

the lower mounting column is integrally formed with the lower sidewall and faces towards the connecting column, the lower mounting column includes a third part connected to the lower sidewall and a fourth part connected to the third part, with a diameter of the third part being greater than that of the fourth part, and a height of third part being less than that of the fourth part; the third part is positioned in the lower notch, and the fourth part is engaged in the mounting through hole.

2. The building block according to claim 1, wherein an upper side of the circumferential surrounding wall group is connected to the upper sidewall, a lower side of the circumferential surrounding wall group is connected to the lower sidewall, a first chamber is formed by jointly surrounding the circumferential surrounding wall group, the upper sidewall and the lower sidewall, and the circumferential surrounding wall group, the inner enclosure wall and the stop column are integrally formed.

3. The building block according to claim 2, wherein the upper sidewall is connected to the circumferential surrounding wall group by ultrasonic welding, and the lower sidewall is connected to the circumferential surrounding wall group by ultrasonic welding.

4. The building block according to claim 2, wherein the building block main body is in the shape of a square, the circumferential surrounding wall group comprises a front sidewall, a rear sidewall, a left sidewall and a right sidewall, a right side of the front sidewall is connected to the right sidewall, an upper side of the front sidewall and an upper side of the right sidewall are respectively connected to the upper sidewall, and a lower side of the front sidewall and a lower side of the right sidewall are respectively connected to the lower sidewall; a left side of the front sidewall is connected to the left sidewall, the upper side of the front sidewall and an upper side of the left sidewall are respectively connected to the upper sidewall, and the lower side of the front sidewall and a lower side of the left sidewall are respectively connected to the lower sidewall; a right side of the rear sidewall is connected to the right sidewall, an upper side of the rear sidewall and the upper side of the right sidewall are respectively connected to the upper sidewall, and a lower side of the rear sidewall and the lower side of the right sidewall are respectively connected to the lower sidewall; a left side of the rear sidewall is connected to the left sidewall, the upper side of the rear sidewall and the upper side of the left sidewall are respectively connected to the upper sidewall, and the lower side of the rear sidewall and the lower side of the left sidewall are respectively connected to the lower sidewall.

5. The building block according to claim 4, wherein the inner enclosure wall further comprises a first inner enclosure wall, a second inner enclosure wall, a third inner enclosure wall and a fourth inner enclosure wall; the compartment comprises a first compartment, a second compartment, a third compartment and a fourth compartment; the first inner enclosure wall is connected to inner surfaces of the front sidewall, the left sidewall, the upper sidewall and the lower sidewall, and they jointly surround to form the first compartment; the second inner enclosure wall is connected to inner surfaces of the front sidewall, the right sidewall, the upper sidewall and the lower sidewall, and they jointly surround to form the second compartment, the third inner enclosure wall is connected to inner surfaces of the rear sidewall, the left sidewall, the upper sidewall and the lower sidewall, and they jointly surround to form the third compartment; the fourth inner enclosure wall is connected to inner surfaces of the rear sidewall, the right sidewall, the upper sidewall and the lower sidewall, and they jointly surround to form the fourth compartment.

6. The building block according to claim 5, wherein the stop column comprises a first stop column, a second stop column, a third stop column, and a fourth stop column; the first stop column is positioned in the first compartment, the second stop column is positioned in the second compartment, the third stop column is positioned in the third compartment, and the fourth stop column is positioned in the fourth compartment.

7. The building block according to claim 6, wherein the first inner enclosure wall comprises a first inner enclosure edge connected to the left sidewall and a second inner enclosure edge connected to the front sidewall, the first inner enclosure edge is connected to the second inner enclosure edge and a first included angle is formed, and the first stop column is connected at the first included angle through a first connecting arm; the second inner enclosure wall comprises a third inner enclosure edge connected to the right sidewall and a fourth inner enclosure edge connected to the front sidewall, the third inner enclosure edge is connected to the fourth inner enclosure edge and a second included angle is formed, and the second stop column is connected at the second included angle through a second connecting arm; the third inner enclosure wall comprises a fifth inner enclosure edge connected to the left sidewall and a sixth inner enclosure edge connected to the rear sidewall, the fifth inner enclosure edge is connected to the sixth inner enclosure edge and a third included angle is formed, and the third stop column is connected at the third included angle through a third connecting arm; the fourth inner enclosure wall comprises a seventh inner enclosure edge connected to the right sidewall and a eighth inner enclosure edge connected to the rear sidewall, the seventh inner enclosure edge is connected to the eighth inner enclosure edge and a fourth included angle is formed, and the fourth stop column is connected at the fourth included angle through a fourth connecting arm.

8. The building block according to claim 7, wherein the first inner enclosure wall further comprises a first connecting column arranged between the first inner enclosure edge and the second inner enclosure edge, and the first connecting arm is connected to the first connecting column; the second inner enclosure wall further comprises a second connecting column arranged between the third inner enclosure edge and the fourth inner enclosure edge, and the second connecting arm is connected to the second connecting column; the third inner enclosure wall further comprises a third connecting column arranged between the fifth inner enclosure edge and the sixth inner enclosure edge, and the third connecting arm is connected to the third connecting column; the fourth inner enclosure wall further comprises a fourth connecting column arranged between the seventh inner enclosure edge and the eighth inner enclosure edge, and the fourth connecting arm is connected to the fourth connecting column.

9. The building block according to claim 8, wherein the first connecting column is provided with a first mounting through hole, the second connecting column is provided with a second mounting through hole, the third connecting column is provided with a third mounting through hole, and the fourth connecting column is provided with a fourth mounting through hole; a first upper mounting column, a second upper mounting column, a third upper mounting column and a fourth upper mounting column are arranged at the inner side of the connection between the upper sidewall and the circumferential surrounding wall group, and a first lower mounting column, a second lower mounting column, a third lower mounting column and a fourth lower mounting column are arranged at the inner side of the connection between the lower sidewall and the circumferential surrounding wall group; when the upper sidewall is connected to the circumferential surrounding wall group, the first upper mounting column is matched with and inserted into the first mounting through hole, the second upper mounting column is matched with and inserted into the second mounting through hole, the third upper mounting column is matched with and inserted into the third mounting through hole, and the fourth upper mounting column is matched with and inserted into the fourth mounting through hole; when the lower sidewall is connected to the circumferential surrounding wall group, the first lower mounting column is matched with and inserted into the first mounting through hole, the second lower mounting column is matched with and inserted into the second mounting through hole, the third lower mounting column is matched with and inserted into the third mounting through hole, and the fourth lower mounting column is matched with and inserted into the fourth mounting through hole.

10. The building block according to claim 9, wherein the crossed corner comprises a first crossed corner unit arranged at a junction between the front sidewall, the left sidewall and the upper sidewall, a second crossed corner unit arranged at a junction between the front sidewall, the left sidewall and the lower sidewall, a third crossed corner unit arranged at a junction between the front sidewall, the right sidewall and the upper sidewall, a fourth crossed corner unit arranged at a junction between the front sidewall, the right sidewall and the lower sidewall, a fifth crossed corner unit arranged at a junction between the rear sidewall, the left sidewall and the upper sidewall, a sixth crossed corner unit arranged at a junction between the rear sidewall, the left sidewall and the lower sidewall, a seventh crossed corner unit arranged at a junction between the rear sidewall, the right sidewall and the upper sidewall, and a eighth crossed corner unit arranged at a junction between the rear sidewall, the right sidewall and the lower sidewall.

11. The building block according to claim 10, wherein the first compartment comprises a first upper compartment unit arranged at the first crossed corner unit and a first lower compartment unit arranged at the second crossed corner unit; the second compartment comprises a second upper compartment unit arranged at the third crossed corner unit and a second lower compartment unit arranged at the fourth crossed corner unit; the third compartment comprises a third upper compartment unit arranged at the fifth crossed corner unit and a third lower compartment unit arranged at the sixth crossed corner unit; and the fourth compartment comprises a fourth upper compartment unit arranged at the seventh crossed corner unit and a fourth lower compartment unit arranged at the eighth crossed corner unit.

12. The building block according to claim 11, wherein the magnet comprises a first magnet unit arranged in the first upper compartment unit, a second magnet unit arranged in the first lower compartment unit, a third magnet unit arranged in the second upper compartment unit, a fourth magnet unit arranged in the second lower compartment unit, a fifth magnet unit arranged in the third upper compartment unit, a sixth magnet unit arranged in the third lower compartment unit, a seventh magnet unit arranged in the fourth upper compartment unit, and a eighth magnet unit arranged in the fourth lower compartment unit.

13. The building block according to claim 12, wherein an upper side of the first stop column, the first inner enclosure wall and the upper sidewall keep the first magnet unit blocked inside the first upper compartment unit, a lower side of the first stop column, the first inner enclosure wall and the lower sidewall keep the second magnet unit blocked inside the first lower compartment unit, an upper side of the second stop column, the second inner enclosure wall and the upper sidewall keep the third magnet unit blocked inside the second upper compartment unit, a lower side of the second stop column, the second inner enclosure wall and the lower sidewall keep the fourth magnet unit blocked inside the second lower compartment unit, an upper side of the third stop column, the third inner enclosure wall and the upper sidewall keep the fifth magnet unit blocked inside the third upper compartment unit, a lower side of the third stop column, the third inner enclosure wall and the lower sidewall keep the sixth magnet unit blocked inside the third lower compartment unit, an upper side of the fourth stop column, the fourth inner enclosure wall and the upper sidewall keep the seventh magnet unit blocked inside the fourth upper compartment unit, and a lower side of the fourth stop column, the fourth inner enclosure wall and the lower sidewall keep the eighth magnet unit blocked inside the fourth lower compartment unit.

14. The building block according to claim 1, wherein the connecting arm is positioned at a middle position of the included angle.

15. The building block according to claim 1, wherein the magnet is able to rotate in the compartment, and the magnet is provided with an N pole and an S pole.

16. A building block, comprising:

a building block main body, wherein the building block main body is formed by a plurality of sidewalls connected to each other, a crossed corner is formed at a junction between adjacent sidewalls, an inner enclosure wall and a stop column are arranged at the crossed corner, a compartment is formed by surrounding the inner enclosure wall and the adjacent sidewalls, the stop column is positioned in the compartment, and the inner enclosure wall and the stop column are integrally formed;

a rotatable magnet, wherein the inner enclosure wall and the stop column are configured for stopping the magnet at the compartment;

wherein the plurality of sidewalls comprise a circumferential surrounding wall group, an upper sidewall and a lower sidewall formed by connecting in sequence, an upper side of the circumferential surrounding wall group is connected to the upper sidewall, a lower side of the circumferential surrounding wall group is connected to the lower sidewall, a first chamber is formed by jointly surrounding the circumferential surrounding wall group, the upper sidewall and the lower sidewall, and the circumferential surrounding wall group, the inner enclosure wall and the stop column are integrally formed;

wherein the inner enclosure wall comprises a first enclosure edge and a second enclosure edge connected to two adjacent sidewalls respectively, the first enclosure edge is connected to the second enclosure edge and an included angle is formed, the stop column is connected to the inner enclosure wall through a connecting arm, and the connecting arm is connected at the included angle;

the inner enclosure wall further comprises a connecting column arranged between the first enclosure edge and the second enclosure edge, and the connecting arm is connected to the connecting column;

wherein the connecting column is provided with a mounting through hole, an upper mounting column is arranged at an inner side of a connection between the upper sidewall and the circumferential surrounding wall group, and when the upper sidewall is connected to the circumferential surrounding wall group, the upper mounting column is matched with and inserted into the mounting through hole; a lower mounting column is arranged at an inner side of a connection between the lower sidewall and the circumferential surrounding wall group, and when the lower sidewall is connected to the circumferential surrounding wall group, the lower mounting column is matched with and inserted into the mounting through hole;

wherein the upper sidewall comprises a fourth enclosure edge protruded from the upper sidewall and facing towards the compartment; the fourth enclosure edge arranged above the first enclosure edge and the second enclosure edge, and the fourth enclosure edge surrounding at least a part of the compartment, the fourth enclosure edge is connected to the first enclosure edge and the second enclosure edge by ultrasonic welding to allow the fourth enclosure edge, the first enclosure edge and the second enclosure edge cooperatively accommodate the magnet in the compartment.

17. A building block, comprising:

a building block main body, wherein the building block main body is formed by a plurality of sidewalls connected to each other, a crossed corner is formed at a junction between adjacent sidewalls, an inner enclosure wall and a stop column are arranged at the crossed corner, a compartment is formed by surrounding the inner enclosure wall and the adjacent sidewalls, the stop column is positioned in the compartment, and the inner enclosure wall and the stop column are integrally formed;

a rotatable magnet, wherein the inner enclosure wall and the stop column are configured for stopping the magnet at the compartment;

wherein the plurality of sidewalls comprise a circumferential surrounding wall group, an upper sidewall and a lower sidewall formed by connecting in sequence; and the inner enclosure wall comprises a first enclosure edge and a second enclosure edge connected to two adjacent sidewalls respectively, the first enclosure edge is connected to the second enclosure edge and an included angle is formed, the stop column is connected to the inner enclosure wall through a connecting arm, and the connecting arm is connected at the included angle;

the inner enclosure wall further comprises a connecting column arranged between the first enclosure edge and the second enclosure edge, and the connecting arm is connected to the connecting column;

wherein the connecting column is provided with a mounting through hole, an upper mounting column is arranged at an inner side of a connection between the upper sidewall and the circumferential surrounding wall group, and when the upper sidewall is connected to the circumferential surrounding wall group, the upper mounting column is matched with and inserted into the mounting through hole; a lower mounting column is arranged at an inner side of a connection between the lower sidewall and the circumferential surrounding wall group, and when the lower sidewall is connected to the circumferential surrounding wall group, the lower mounting column is matched with and inserted into the mounting through hole;

wherein the upper sidewall comprises a third enclosure edge and a fourth enclosure edge each protruded from the upper sidewall and facing towards the compartment; the third enclosure edge is arranged at a corner of the upper sidewall, and the fourth enclosure edge is connected to the upper mounting column; and a height and a width of third enclosure edge are greater than those of the fourth enclosure edge, the third enclosure edge inserted in the compartment and surrounding at least a part of the compartment, and the fourth enclosure edge is connected to the first enclosure edge and the second enclosure edge by ultrasonic welding to allow the fourth enclosure edge, the first enclosure edge and the second enclosure edge cooperatively accommodate the magnet in the compartment.

18. A building block, comprising:

a building block main body, wherein the building block main body is formed by a plurality of sidewalls connected to each other, a crossed corner is formed at a junction between adjacent sidewalls, an inner enclosure wall and a stop column are arranged at the crossed corner, a compartment is formed by surrounding the inner enclosure wall and the adjacent sidewalls, the stop column is positioned in the compartment, and the inner enclosure wall and the stop column are integrally formed;

a rotatable magnet, wherein the inner enclosure wall and the stop column are configured for stopping the magnet at the compartment;

wherein the plurality of sidewalls comprise a circumferential surrounding wall group, an upper sidewall and a lower sidewall formed by connecting in sequence; and the inner enclosure wall comprises a first enclosure edge and a second enclosure edge connected to two adjacent sidewalls respectively, the first enclosure edge is connected to the second enclosure edge and an included angle is formed, the stop column is connected to the inner enclosure wall through a connecting arm, and the connecting arm is connected at the included angle;

the inner enclosure wall further comprises a connecting column arranged between the first enclosure edge and the second enclosure edge, and the connecting arm is connected to the connecting column;

wherein the connecting column is provided with a mounting through hole, an upper mounting column is arranged at an inner side of a connection between the upper sidewall and the circumferential surrounding wall group, and when the upper sidewall is connected to the circumferential surrounding wall group, the upper mounting column is matched with and inserted into the mounting through hole; a lower mounting column is arranged at an inner side of a connection between the lower sidewall and the circumferential surrounding wall group, and when the lower sidewall is connected to the circumferential surrounding wall group, the lower mounting column is matched with and inserted into the mounting through hole;

wherein the upper sidewall comprises a third enclosure edge and a fourth enclosure edge each protruded from the upper sidewall and facing towards the compartment; the third enclosure edge is arranged at a corner of the upper sidewall; the third enclosure edge inserted in the compartment and surrounding at least a part of the compartment, and the fourth enclosure edge is connected to the first enclosure edge and the second enclosure edge by ultrasonic welding to allow the fourth enclosure edge, the first enclosure edge and the second enclosure edge cooperatively accommodate the magnet in the compartment.

19. A building block, comprising:

a building block main body, wherein the building block main body is formed by a plurality of sidewalls connected to each other, a crossed corner is formed at a junction between adjacent sidewalls, an inner enclosure wall and a stop column are arranged at the crossed corner, a compartment is formed by surrounding the inner enclosure wall and the adjacent sidewalls, the stop column is positioned in the compartment, and the inner enclosure wall and the stop column are integrally formed;

a rotatable magnet, wherein the inner enclosure wall and the stop column are configured for stopping the magnet at the compartment;

wherein the plurality of sidewalls comprise a circumferential surrounding wall group, an upper sidewall and a lower sidewall formed by connecting in sequence, an upper side of the circumferential surrounding wall group is connected to the upper sidewall, a lower side of the circumferential surrounding wall group is connected to the lower sidewall, a first chamber is formed by jointly surrounding the circumferential surrounding wall group, the upper sidewall and the lower sidewall, and the circumferential surrounding wall group, the inner enclosure wall and the stop column are integrally formed;

wherein the inner enclosure wall comprises a first enclosure edge and a second enclosure edge connected to two adjacent sidewalls respectively, the first enclosure edge is connected to the second enclosure edge and an included angle is formed, the stop column is connected to the inner enclosure wall through a connecting arm, and the connecting arm is connected at the included angle;

the inner enclosure wall further comprises a connecting column arranged between the first enclosure edge and the second enclosure edge, and the connecting arm is connected to the connecting column;

wherein the connecting column is provided with a mounting through hole, an upper mounting column is arranged at an inner side of a connection between the upper sidewall and the circumferential surrounding wall group, and when the upper sidewall is connected to the circumferential surrounding wall group, the upper mounting column is matched with and inserted into the mounting through hole; a lower mounting column is arranged at an inner side of a connection between the lower sidewall and the circumferential surrounding wall group, and when the lower sidewall is connected to the circumferential surrounding wall group, the lower mounting column is matched with and inserted into the mounting through hole;

wherein the upper sidewall comprises a third enclosure edge protruded from the upper sidewall and facing towards the compartment; the third enclosure edge is arranged at a corner of the upper sidewall and is connected to the circumferential surrounding wall group, and the third enclosure edge is inserted in the compartment and surrounds at least a part of the compartment.

* * * * *